US006896204B1

(12) United States Patent
Greene et al.

(10) Patent No.: US 6,896,204 B1
(45) Date of Patent: May 24, 2005

(54) WATER PRESSURED DESTRUCT ENHANCER

(75) Inventors: Michael L. Greene, Fort Washington, MD (US); Samuel J. DeVane, Nanjemoy, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 17 days.

(21) Appl. No.: 10/695,364

(22) Filed: Oct. 29, 2003

Related U.S. Application Data

(63) Continuation-in-part of application No. 10/055,254, filed on Jan. 24, 2002, now abandoned, which is a continuation of application No. 09/606,164, filed on Jun. 29, 2000, now abandoned.

(51) Int. Cl.[7] ..... A62C 13/62

(52) U.S. Cl. ..... 239/309; 239/329; 239/331; 239/504; 239/518; 239/548; 239/589; 239/289; 169/46; 169/12; 169/72; 169/84

(58) Field of Search ..... 239/309, 329, 239/331, 504, 518, 548, 589; 169/46, 6, 11, 169/12, 71, 72, 84, 85, 289; 261/115

(56) References Cited

U.S. PATENT DOCUMENTS

| | | | | |
|---|---|---|---|---|
| 2,145,865 | A | * | 2/1939 | Diehl |
| 2,366,354 | A | * | 1/1945 | Robbins |
| 2,582,112 | A | * | 1/1952 | Ferguson |
| 2,738,962 | A | * | 3/1956 | Goodrie |
| 3,613,794 | A | * | 10/1971 | Naumann |
| 3,773,111 | A | * | 11/1973 | Dunn |
| 4,801,090 | A | * | 1/1989 | Yoshida et al. |
| 4,917,299 | A | * | 4/1990 | Kondo et al. |
| 5,085,371 | A | * | 2/1992 | Paige |
| 5,330,105 | A | * | 7/1994 | Kaylor |
| 5,725,155 | A | * | 3/1998 | Grunenberg et al. |
| 5,934,568 | A | * | 8/1999 | Brown |

* cited by examiner

*Primary Examiner*—Christopher Kim
(74) *Attorney, Agent, or Firm*—Frederic Zimmerman

(57) ABSTRACT

The present invention comprises an extension tube that attaches to the bore end of a water jet producing device that is used to render safe improvised explosive devices by disrupting the firing train of said devices. The present invention comprises an extension tube having a sudden enlargement of cross section, that may be formed by adjusting the dimensions of the interior diameter of the extension tube, at the point of attachment, and a series of apertures in the attachment tube. The extension tube provides a more uniform jet of water with more focused energy by containing the jet until breech pressures are vented. Better control of the water jet will be maintained during firing operations. Further, more energy may be put into the water jet to accomplish specific tasks.

11 Claims, 3 Drawing Sheets

SECTION A–A

WATER PRESSURED DESTRUCT ENHANCER

PRIORITY STATEMENT

This application is a continuation-in-part of application Ser. No. 10/055,254, filed on Jan. 24, 2002, now abandoned, which was a continuation application of application Ser. No. 09/606,164, filed on Jun. 29, 2000, now abandoned.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to an improvement in water cannons, and more particularly to water cannons used to render safe explosive devices. The present invention improves the performance of such systems, particularly related to their use to render safe explosive devices.

2. Description of the Related Art

Presently, devices using water to disrupt detonation of explosive devices are widely used. This is because of the relatively low velocity and density of a water jet. These devices normally comprise a slug of water contained within a tube between a burst diaphragm and an obturated pusher plate or piston. When pressure is applied to the pusher plate or piston, the burst diaphragm ruptures and a jet of water issues from the device. Pressure to the pusher plate or piston is normally applied by burning a gun propellant that is housed in a cartridge or as a breech charge. The propellant can be ignited electrically, mechanically, or through other means. Electrical initiation of the firing train may start with a planar bridge element, electric match, squib, or shock tube. Mechanical initiation may begin with a primer or flueric device.

One such device, known as a JROD (jet remote operating device), was developed by the United States Navy to render safe improvised explosive devices at close range. The JROD uses the principles named above to supply approximately 600 ft/sec of water to accomplish this task. However, because the back portion of the water slug in the JROD, and other water disrupt devices, remains in the bore and is still being accelerated after the front portion of the water slug begins to jet out of the bore, it tends to push against the jet that has left the bore. This tends to distort, degrade, and brake-up the jet causing the jet to disperse relatively quickly after leaving the bore and result in a reduced forward speed of the jet. Therefore, in order to use such means to render safe explosive devices, these systems must be placed within proximity of the explosive devices.

SUMMARY OF THE INVENTION

The present invention comprises an extension tube that attaches to the bore end of a water based device that is used to render safe improvised explosive devices by disrupting the firing train of said devices. The present invention comprises an extension tube having a sudden enlargement of cross section, that may be formed by adjusting the dimensions of the interior diameter of the extension tube, at the point of attachment, and a series of open apertures in the attachment tube.

The extension tube as herein described will provide a more uniform jet of water with more focused energy by containing the jet until breech pressures are vented. Better control of the water jet will be maintained during firing operations. Further, more energy may be put into the water jet to accomplish specific tasks. These advantages will allow better penetration of the item on which the device is used. Also, for procedures involving rendering safe improvised explosive devices, this invention will allow the operator to set up the water based device at a position that is further away from the explosives.

Accordingly, it is the object of this invention to provide a device which improves the performance of systems that dispense jets of water.

It is a further object of this invention to provide a device to increase the length of the water jet stream of systems that produce such water jet streams.

It is yet a further object of this invention to permit a tool used for rendering safe explosive ordnance that employs a water jet to be used from further than from the current usage distance.

This invention accomplishes these objectives and other needs related to improvement of water jet stream dispensing devices.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises an improvement to devices that produce a jet of water having a water slug, a bore end and an outlet diameter associated with the bore end. In one configuration, such a device comprises a slug of water contained within a tube between a burst diaphragm and an obturated pusher plate or piston. When pressure is applied to the pusher plate or piston, the burst diaphragm ruptures and a jet of water issues from the device. Pressure to the pusher plate or piston is normally applied by burning a gun propellant that is housed in a cartridge or as a breech charge.

The improvement comprises an extension tube having a volume sufficient to hold the entire water slug and a means for attaching the extension tube to the bore end of the device. The extension tube having first and second ends, wherein the first end comprises a location proximate to the attaching means and comprises an inner diameter greater than the inner diameter of the outlet of the device. The inner diameter of the extension tube decreases when moving away from the first end until it becomes approximately equal to the inner diameter of the outlet of the device. The point where the inner diameter of the extension tube stops decreasing depends upon the application of the improved device. At least one aperture to release pressure is located within the extension tube, proximate to the attaching means is incorporated. This extension tube receives the water jet in a cylindrical configuration from the device during the acceleration provided by the device. The abrupt enlargement of the inner diameter of the tube as the water leaves the original device, along with the pressure release ports and the narrowing of the inner diameter of the tube back to its original length follows the general principles of venturi tubes. The water jet will flow into the extension tube with its increase in internal diameter. Because the breech gases are travelling at a substantially greater speed than the water, partially due to some nozzling of the breech gases at the exit of the water jet producing device and also because gases will normally travel faster than liquids, the breech gases will vent through the pressure release apertures rather than continue to push against the water in the extension tube. The venting of the breech gases relieves the pressure that would continue to accelerate the back of the water slug as the front of the water jet exits the extension tube. Therefore, the extension tube provides a more uniform jet of water with more focused energy by containing the jet until the breech pressures are vented.

Figure 1:
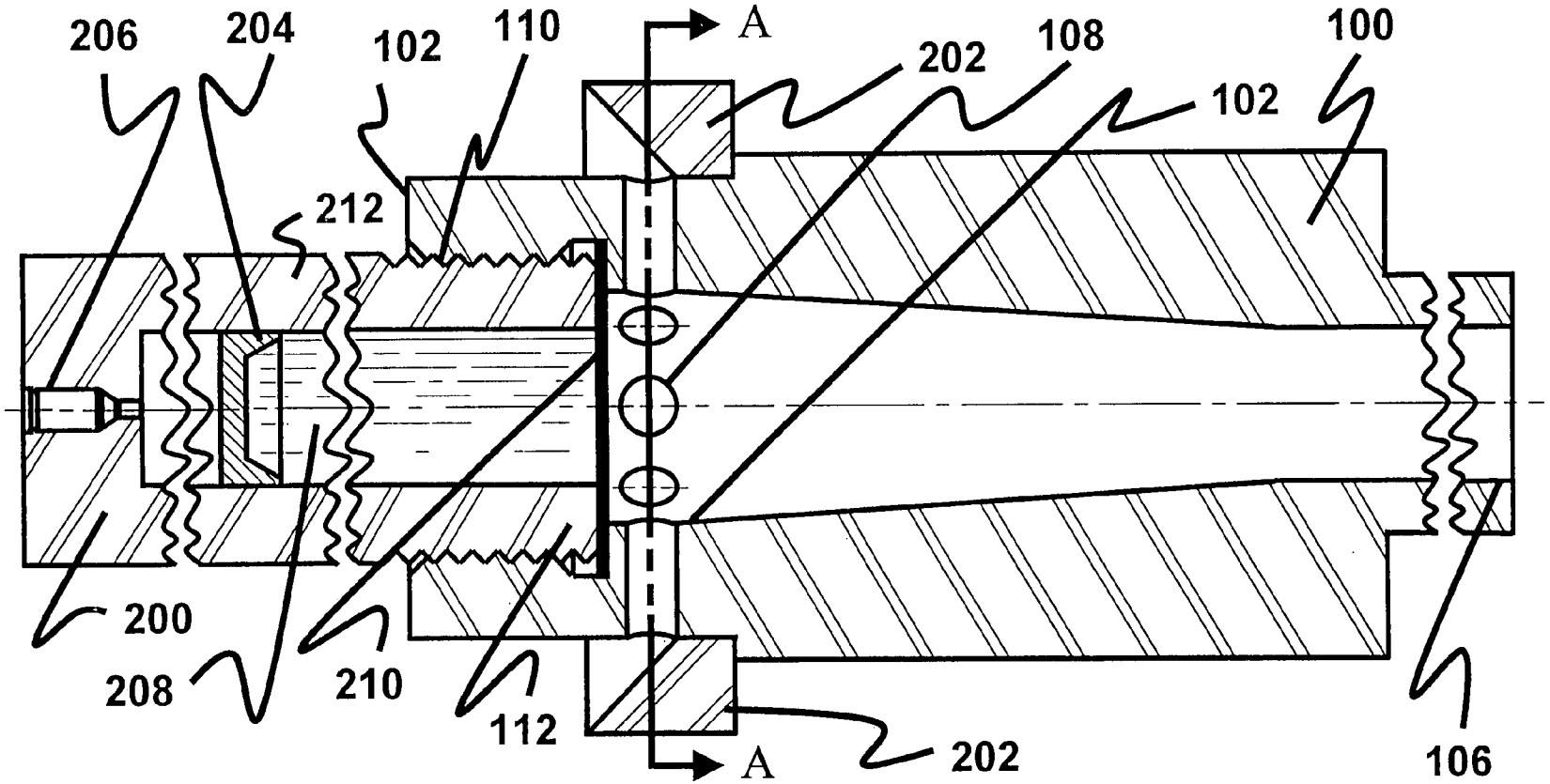
FIG. 1 is a cross-sectional view of an embodiment of the invention connected to the end of a water jet producing device.
Figure 1A:
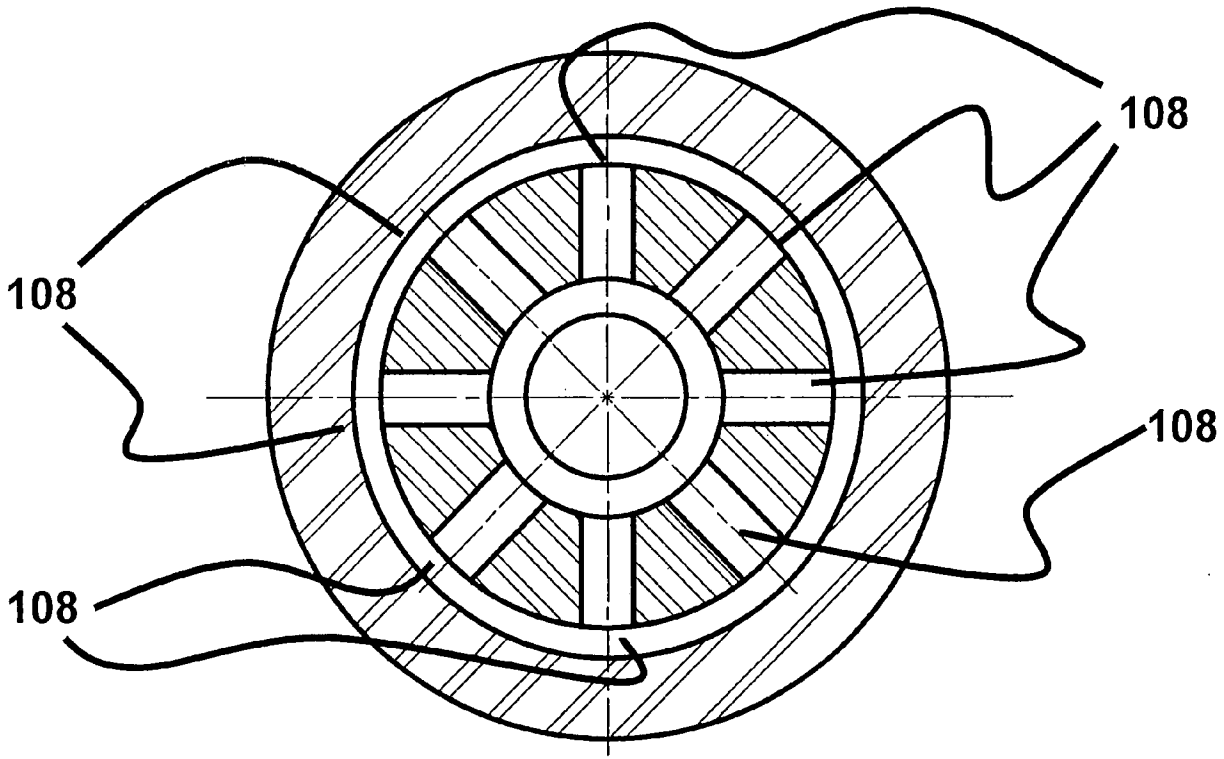
FIG. 1A is a cut-away view of section A—A of FIG. 1 depicting eight apertures.
Figure 2:
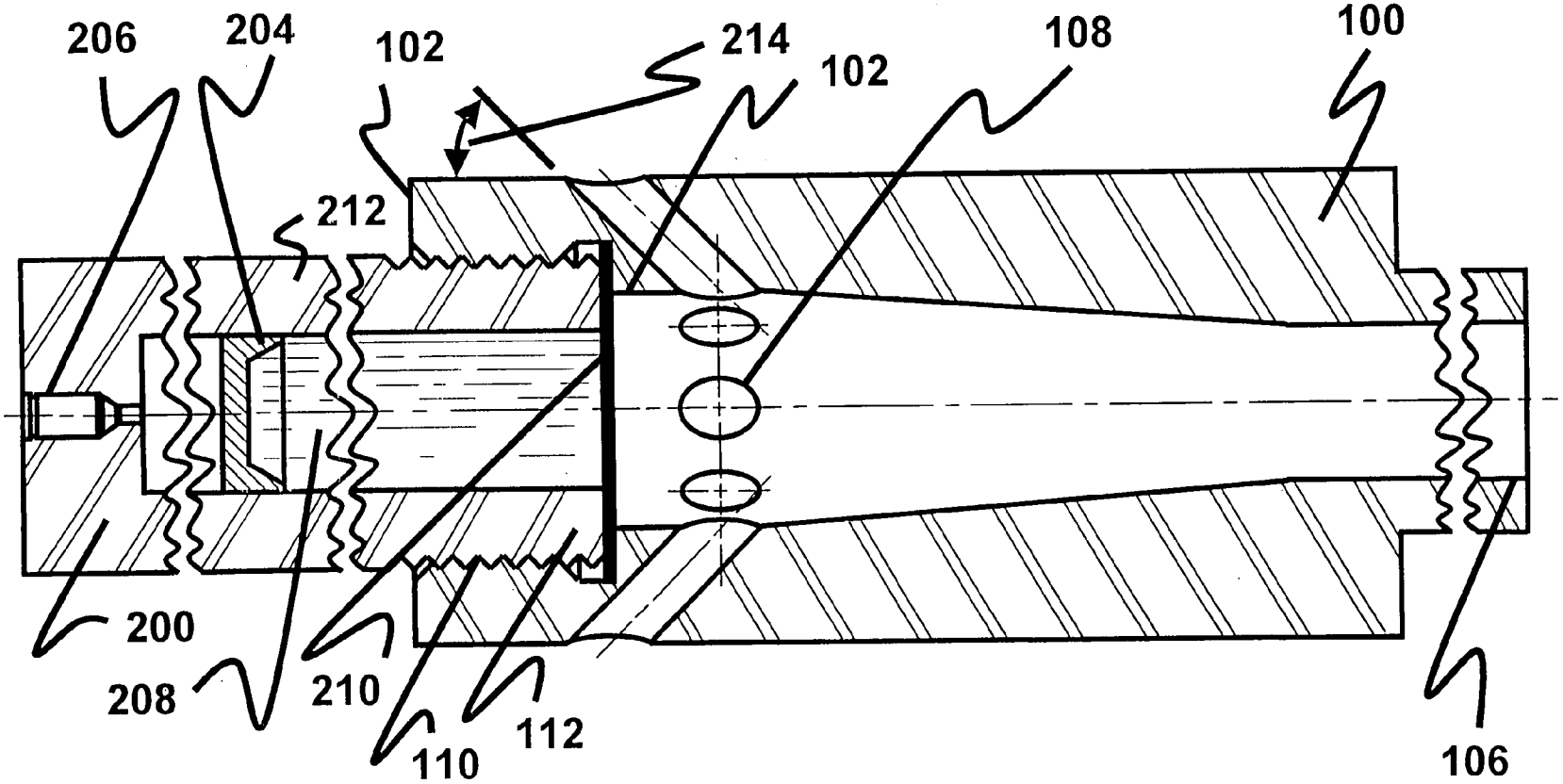
FIG. 2 is a cross-sectional view of an embodiment of the invention wherein the flanges are replaced by angled apertures.

Referring to FIGS. 1, 1A, and 2, the invention comprises a water jet producing device 200 comprising a slug of water 208 contained within a tube 212 between a burst diaphragm 210 and an obturated pusher plate or piston 204. When pressure is applied to the pusher plate or piston 204, the burst diaphragm 210 ruptures and a jet of water issues from the device 200. Pressure to the pusher plate or piston 204 is normally applied by burning a gun propellant that is housed in a cartridge or as a breech charge 206. An extension tube 100 comprises a volume sufficient to hold the entire water slug 208. This is to ensure that breech gases 216 can be vented prior to any portion of the water leaving the extension tube 100. There is an attaching means 110 to attach the extension tube 100 to the bore end 112 of the water jet producing device 200. In one embodiment, the attaching means 110 comprises an inner thread formed in the first end 102 of the extension tube 100 capable of screwing on to the bore end 112 of the water jet producing device. The first end 102 of the extension tube 100 comprises an inner diameter greater than the inner diameter of the bore end 112. The inner diameter of the extension tube 100 decreases when moving away from the first end 102 until it becomes approximately equal to the inner diameter of the bore end 112 of the water jet producing device. The point where the inner diameter of the extension tube stops decreasing depends upon the application of the improved device. The extension tube 100 also comprises at least one pressure release aperture 108 located proximate to the attaching means 110. Flange(s) 202 may be placed proximate to the at least one aperture 108 to direct the gases 216 exiting the at least one aperture 108 away from the end of the extension tube 100.

In one preferred embodiment of the invention, the extension tube 100 is used in conjunction with a jet remote operating device water disrupt device 200. In this embodiment, the extension tube 100 comprises a first end 102 comprising a diameter of approximately 1.5 inches and a plurality of pressure release apertures 108, or more preferably eight pressure release apertures 108. FIG. 1A, which is a cut-away of section A—A from FIG. 1, most clearly shows the preferred eight pressure release apertures 108. The pressure release apertures comprise a diameter of from about 0.3 inches to about 0.5 inches.

Depicted in FIG. 2, the pressure release apertures 108 may further comprise angled tubes 214 so that the breech gases that escapes the apertures 108 are directed away from the second end of the outer barrel 106. This is done to reduce recoil from the device. Depicted in FIG. 1, flanges 202 that force escaping breech gases in a direction opposite of the second end of the outer barrel 106 may also be used for this purpose. The inner diameter of the bore end 112 of a water disrupt device normally comprises approximately 1.0 inch. In this embodiment, the extension tube 100 uniformly decreases in diameter to approximately 1 inch at the second end of the outer barrel 106. In another preferred embodiment of the invention, the extension tube 100 comprises a nozzle (not shown) attached to the second end 106 in order to more fully guide the water jet. Finally, the preferred material to construct the extension tube 100 is steel.

The present invention also includes a method for disrupting the firing train of unexploded ordnance. This method comprises the step of providing a JROD water disrupt device as described above along with the extension tube improvement described above. The remaining steps include aiming the device at the unexploded ordnance and firing the device. The water jet should disrupt the firing train of the ordnance, thereby, rendering the ordnance safe for disposal.

What is described are specific examples of many possible variations on the same invention and are not intended in a limiting sense. The claimed invention can be practiced using other variations not specifically described above.

What is claimed is:

1. A water jet producing device, comprising:

a tube having a slug of water therein;

a burst diaphragm proximate to the slug of water;

a pusher plate proximate to the slug of water and opposite to the burst diaphragm;

a breech charge proximate to the pusher plate wherein initiation of the breech charge produces breech gases;

said tube having a bore end, having an inner diameter;

an extension tube, comprising:

an inner diameter;

a first end, having an inner diameter greater than the inner diameter of the bore end, wherein the inner diameter of the extension tube decreases when moving away from the first end until the inner diameter of the extension tube approximately equals the inner diameter of the bore end;

a volume sufficient to hold the water slug;

means for attaching the first end of the extension tube to the bore end; and, at least one aperture located within the extension tube, proximate the attaching means wherein the breech gases vent through the at least one aperture.

2. The extension tube of claim 1, the attachment means comprising an inner thread capable of screwing on to the bore end of the water jet producing device.

3. The extension tube of claim 2, further comprising angled tubes attached to the at least one aperture wherein the breech gases are directed away from a second end of the extension tube.

4. The extension tube of claim 2, further comprising at least one flange placed proximate to the at least one aperture wherein the at least one flange directs the breech gases escaping through the at least one aperture away from the second end.

5. The extension tube of claim 2, further comprising eight apertures.

6. The extension tube of claim 5, wherein the extension tube comprises steel.

7. The extension tube of claim 6, wherein the inner diameter of the first end comprises approximately 1.5 inches.

8. The extension tube of claim 7, wherein the inner diameter of the bore end comprises approximately 1 inch.

9. The extension tube of claim 8, wherein the apertures further comprise a diameter from about 0.3 to about 0.5 inches.

10. A method for disrupting the firing train of unexploded ordnance, comprising the steps of:

providing a water jet producing device comprising a tube having a slug of water therein, a burst diaphragm proximate to the slug of water, a pusher plate proximate to the slug of water and opposite to the burst diaphragm, a breech charge proximate to the pusher plate wherein initiation of the breech charge produces breech gases, said tube having a bore end, and an inner diameter associated with the bore end, an extension tube comprising an inner diameter, a first end, having an inner diameter greater than the inner diameter of the bore end, wherein the inner diameter of the extension tube decreases when moving away from the first end until the inner diameter of the extension tube approximately equals the inner diameter of the bore end, a volume sufficient to hold the water slug, means for attaching the first end of the extension tube to the bore end, and, at least one pressure release port located within the extension tube, proximate the attaching means wherein the breech gases vent through the at least one aperture;

aiming the water jet producing device at the firing train; and, initiating the water jet producing device.

11. A water jet producing device, comprising:

a tube having a slug of water therein;

a burst diaphragm proximate to the slug of water;

a piston proximate to the slug of water and opposite to the burst diaphragm;

a breech charge proximate to the pusher plate wherein initiation of the breech charge produces breech gases;

said tube having a bore end, having an inner diameter;

an extension tube, comprising:

an inner diameter;

a first end, having an inner diameter greater than the inner diameter of the bore end, wherein the inner diameter of the extension tube decreases when moving away from the first end until the inner diameter of the extension tube approximately equals the inner diameter of the bore end;

a volume sufficient to hold the water slug;

means for attaching the first end of the extension tube to the bore end; and, at least one aperture located within the extension tube, proximate the attaching means wherein the breech gases vent through the at least one aperture.

* * * * *